US012733764B2

(12) United States Patent
Huang et al.

(10) Patent No.: US 12,733,764 B2
(45) Date of Patent: Sep. 15, 2026

(54) MOUNTING DEVICE FOR A BLIND

(71) Applicant: BEAUTIFUL WINDOW FASHIONS CO., LTD., Changhua County (TW)

(72) Inventors: Szu-Chang Huang, Changhua County (TW); Zhuo Cai, Taicang (CN)

(73) Assignee: Beautiful Window Fashions Co., Ltd., Changhua County (TW)

( * ) Notice: Subject to any disclaimer, the term of this patent is extended or adjusted under 35 U.S.C. 154(b) by 19 days.

(21) Appl. No.: 19/093,446

(22) Filed: Mar. 28, 2025

(65) Prior Publication Data

US 2026/0165522 A1 Jun. 18, 2026

(30) Foreign Application Priority Data

Dec. 17, 2024 (TW) ..... 113149156

(51) Int. Cl.

| | |
|---|---|
| ***A47H 1/13*** | (2006.01) |
| ***A47H 1/08*** | (2006.01) |
| ***A47H 1/122*** | (2006.01) |
| ***A47H 1/124*** | (2006.01) |

(52) U.S. Cl.

CPC ..... *A47H 1/13* (2013.01); *A47H 1/08* (2013.01); *A47H 1/122* (2013.01); *A47H 1/124* (2013.01)

(58) Field of Classification Search

CPC . A47H 1/13; A47H 1/08; A47H 1/122; A47H 1/124

USPC ..... 248/257, 259

See application file for complete search history.

(56) References Cited

U.S. PATENT DOCUMENTS

| | | | | | |
|---|---|---|---|---|---|
| 790,149 | A * | 5/1905 | Nash | A47H 1/13 | 248/259 |
| 807,108 | A * | 12/1905 | Cooper | A47H 1/13 | 248/252 |
| 936,583 | A * | 10/1909 | Thoreau | A47H 1/13 | 248/259 |
| 978,095 | A * | 12/1910 | Willlet | A47H 1/13 | 248/256 |
| 1,066,157 | A * | 7/1913 | Shorkey | A47H 1/13 | 248/252 |

(Continued)

FOREIGN PATENT DOCUMENTS

| | | | | |
|---|---|---|---|---|
| AU | 2019201666 | A1 * | 10/2019 | A47H 1/13 |
| CA | 2467778 | A1 * | 11/2005 | E06B 9/323 |

(Continued)

*Primary Examiner* — Taylor Morris

(74) *Attorney, Agent, or Firm* — Rosenberg, Klein & Lee

(57) ABSTRACT

A mounting device for a blind includes a connecting rail and two slide rails slidably connected with two ends of the connecting rail. Each of two abutting plates is interposed between the slide rail and the connecting rail, and has a screw hole. Each screw bolt is threadedly engaged in the screw hole and in abutting engagement with the slide rail. Two mounting brackets are mounted on the slide rails for mounting the blind. Through rotation of the screw bolts, the abutting plates are movable between a tightening position, where each abutting plate is in upwardly abutting engagement with the connecting rail so that the connecting rail is in tight contact with the slide rails, and a loosening position, where each abutting plate is moved away from the connecting rail to permit sliding movement of the slide rails to adjust the length of the mounting device.

4 Claims, 9 Drawing Sheets

(56) References Cited

U.S. PATENT DOCUMENTS 1,251,122 A * 12/1917 Smith ..... A47H 1/13 248/252
1,297,139 A * 3/1919 Garnett ..... A47H 1/13 248/259
1,495,642 A * 5/1924 Pinney ..... A47H 1/13 248/252
1,519,548 A * 12/1924 Moore ..... A47H 1/13 248/266
1,588,971 A * 6/1926 Lukenbill ..... A47H 1/13 248/256
1,622,779 A * 3/1927 Frasca ..... A47H 1/13 248/271
1,684,843 A * 9/1928 Newmark ..... A47H 2/02 160/902
1,755,748 A * 4/1930 Robinson ..... A47H 1/13 160/110
1,779,612 A * 10/1930 Moss ..... A47H 1/13 248/259
1,808,971 A * 6/1931 Roberts ..... A47H 1/13 248/259
1,854,635 A * 4/1932 Vidrine ..... A47H 1/13 248/253
1,904,588 A * 4/1933 Weinberg ..... A47H 5/032 160/126
2,117,547 A * 5/1938 Douglas ..... A47H 1/13 248/252
2,120,891 A * 6/1938 Findon, Jr. ..... A47H 1/13 248/259
2,123,097 A * 7/1938 Crates ..... A47H 1/13 248/256
2,210,606 A * 8/1940 Speranza ..... A47H 1/13 248/263
2,268,362 A * 12/1941 Weber ..... A47H 1/13 248/256
2,597,224 A * 5/1952 Stanfield ..... A47H 15/02 16/87.6 R
2,689,103 A * 9/1954 Ackerman ..... A47H 1/122 248/257
2,879,965 A * 3/1959 Pidgeon ..... A47H 1/08 248/269
3,134,132 A * 5/1964 Graber ..... A47H 1/124 248/221.11
3,166,286 A * 1/1965 Pfaff ..... A47H 2/02 160/39
3,425,655 A * 2/1969 Cogdill ..... H02G 3/125 248/57
3,431,585 A * 3/1969 Foltz ..... E05D 15/0652 248/323
3,891,091 A * 6/1975 Anderson ..... A47H 1/144 211/105.3
4,205,816 A * 6/1980 Yu ..... E06B 9/262 160/84.01
4,299,008 A * 11/1981 Burns ..... A47H 1/06 16/95 D
4,724,883 A * 2/1988 Liebowitz ..... E06B 9/368 160/84.01
5,385,323 A * 1/1995 Garelick ..... F16B 7/1472 403/109.5
6,098,945 A * 8/2000 Korcz ..... H02G 3/125 248/200.1
6,108,891 A * 8/2000 Ruggles ..... E06B 9/266 29/434
9,735,557 B1 * 8/2017 Gretz ..... H02G 3/125
10,617,250 B2 * 4/2020 Wahl ..... F16M 13/027
2003/0052244 A1 * 3/2003 Goldstein ..... A47H 1/124 248/262
2008/0053938 A1 * 3/2008 Goldstein ..... A47H 1/022 211/105.3
2008/0156951 A1 * 7/2008 Lin ..... A47H 1/104 248/261
2010/0224332 A1 * 9/2010 Hibshman ..... A47H 5/0325 160/405
2013/0167326 A1 * 7/2013 Rowan ..... A47H 15/02 16/94 D
2014/0224439 A1 * 8/2014 Graves ..... A47H 5/02 160/368.1
2021/0137295 A1 * 5/2021 Tan ..... A47H 1/08
2022/0015563 A1 * 1/2022 Sundelin ..... A47H 1/06
2022/0233011 A1 * 7/2022 Zhu ..... A47H 1/08

FOREIGN PATENT DOCUMENTS

CN 219374340 U * 7/2023 ..... A47H 1/022
CN 222443793 U * 2/2025 ..... A47H 1/08
DE 3802536 A1 * 8/1988 ..... F21V 33/0016
DE 10160870 A1 * 7/2003 ..... A47H 1/104
EP 0120425 A2 * 10/1984 ..... E06B 9/365
GB 1249747 A * 10/1971 ..... A47H 15/04
KR 20240001875 U * 11/2024 ..... A47H 1/08

* cited by examiner

MOUNTING DEVICE FOR A BLIND

CROSS-REFERENCE TO RELATED APPLICATION

This application claims priority to Taiwanese Patent Application No. 113149156, filed on Dec. 17, 2024, and incorporated by reference herein in its entirety.

FIELD

The disclosure relates to a window blind, and more particularly to a mounting device for a window blind.

BACKGROUND

A conventional mounting device for a window blind generally has structural components with specific dimensions that match the window blind. Although current window blinds may be cut into appropriate sizes by customers so as to be suitable for a variety of spaces, conventional mounting devices for the window blinds are not adjustable on the spot, so the mounting devices and the window blinds are not compatible with each other, which is inconvenient to the customers, specifically when the window blinds need to be mounted quickly. For example, when a dimension of a window blind is smaller or greater than that of a standard window blind, the conventional mounting device cannot be used for mounting the window blind. The user then needs to purchase another mounting device or modify the conventional mounting device, which increases time and cost.

SUMMARY

Therefore, an object of the disclosure is to provide a mounting device for a blind that can alleviate at least one of the drawbacks of the prior art.

According to the disclosure, the mounting device for a blind includes a connecting rail, two slide rails, two abutting plates, two screw bolts and two mounting brackets. The connecting rail extends along a lengthwise direction. The slide rails are respectively and slidably connected with two ends of the connecting rail. Each of the slide rails is slidable relative to the connecting rail along the lengthwise direction. Each of the abutting plates is interposed between a respective one of the slide rails and the connecting rail in an up-down direction that is transverse to the lengthwise direction. Each of the abutting plates is moved with the respective one of the slide rails relative to the connecting rail along the lengthwise direction, and has a plate body and a screw hole formed in the plate body. Each of the screw bolts is threadedly engaged in the screw hole of a respective one of the abutting plates and has a lower bolt end which extends through the screw hole to be in abutting engagement with the respective one of the slide rails. The mounting brackets are respectively mounted on the slide rails for mounting the blind thereon. Through rotation of the screw bolts, the abutting plates are movable in the up-down direction between a tightening position, where an upper surface of each of the abutting plates is in upwardly abutting engagement with the connecting rail so that the connecting rail is in tight contact with the slide rails by a frictional force so as to prevent sliding movement of the slide rails relative to the connecting rail, and a loosening position, where the upper surface of each of the abutting plates is moved away from the connecting rail so as to permit the sliding movement of the slide rails relative to the connecting rail along the lengthwise direction.

With the slide rails and the connecting rail, the length of the mounting device is adjustable for mounting blinds with a variety of dimensions. Through the operation of the screw bolts by a customer, the abutting plates may be moved to the loosening position to permit adjustment of the length of the mounting device, and to the tightening position to prevent the sliding movement of the slide rails relative to the connecting rail so as to firmly retain the length of the mounting device, which improves convenience and stability of use.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
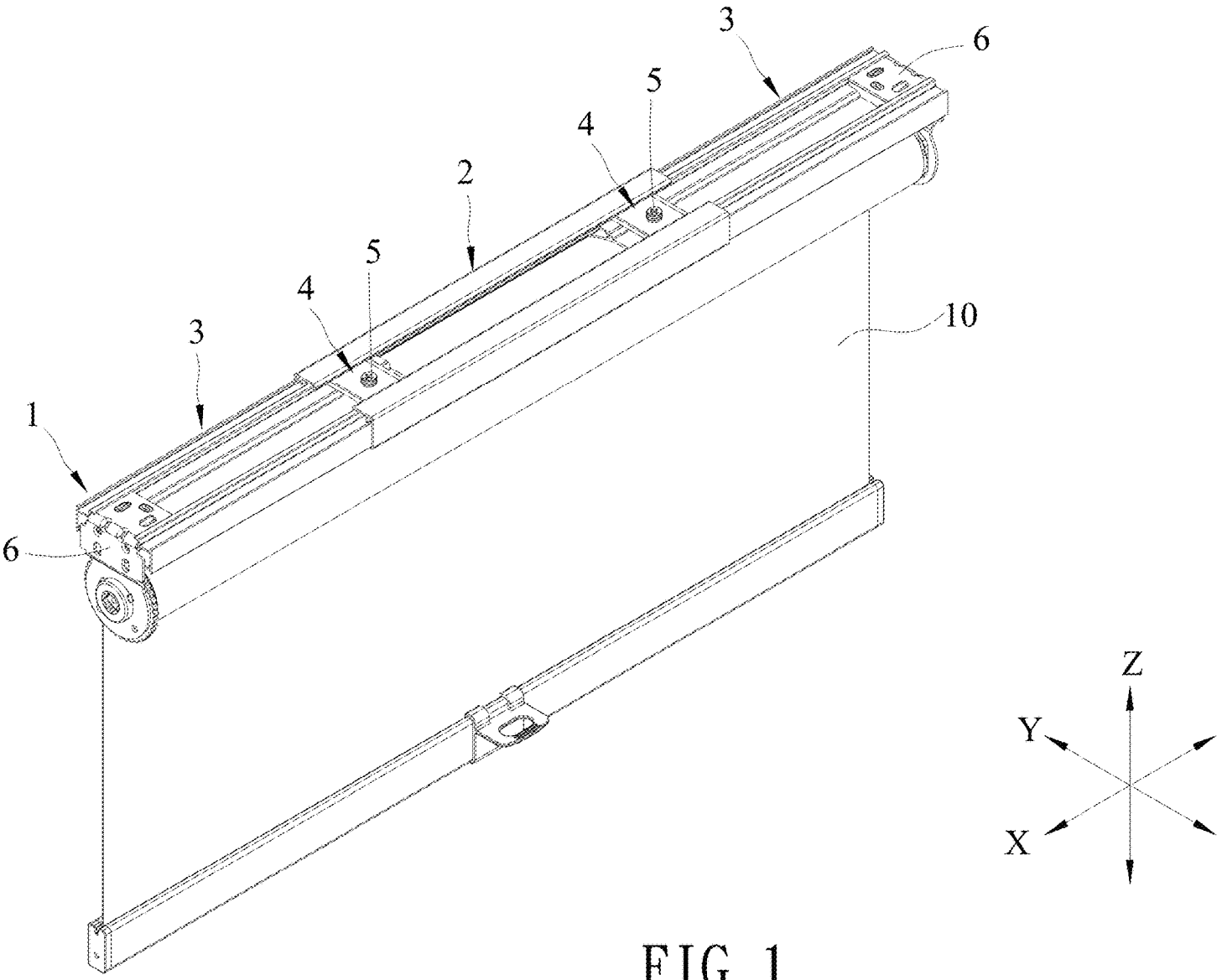
FIG. 1 is a perspective view illustrating an embodiment of a mounting device for a blind according to the disclosure.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
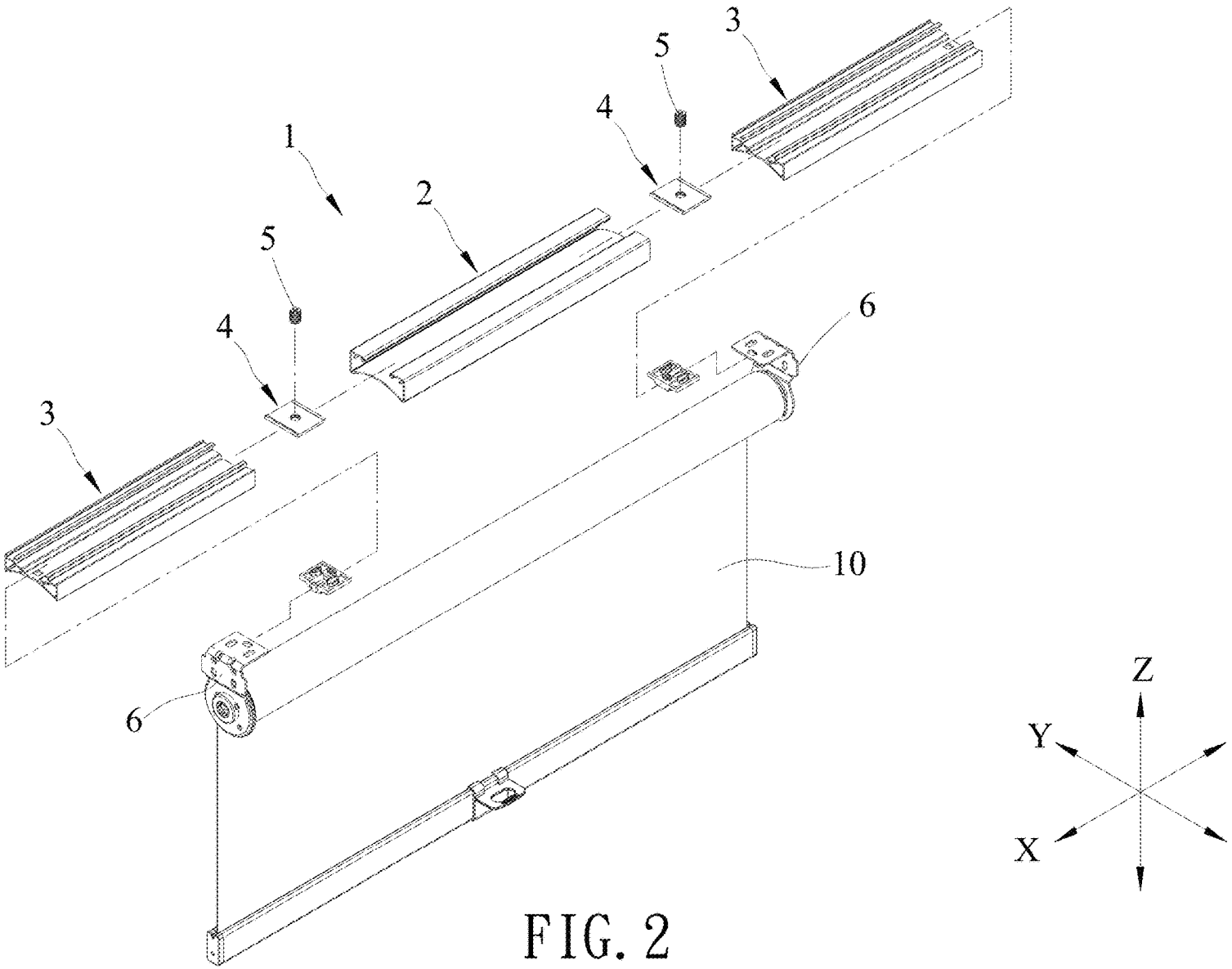
FIG. 2 is an exploded perspective view of the embodiment.
Figure 3:
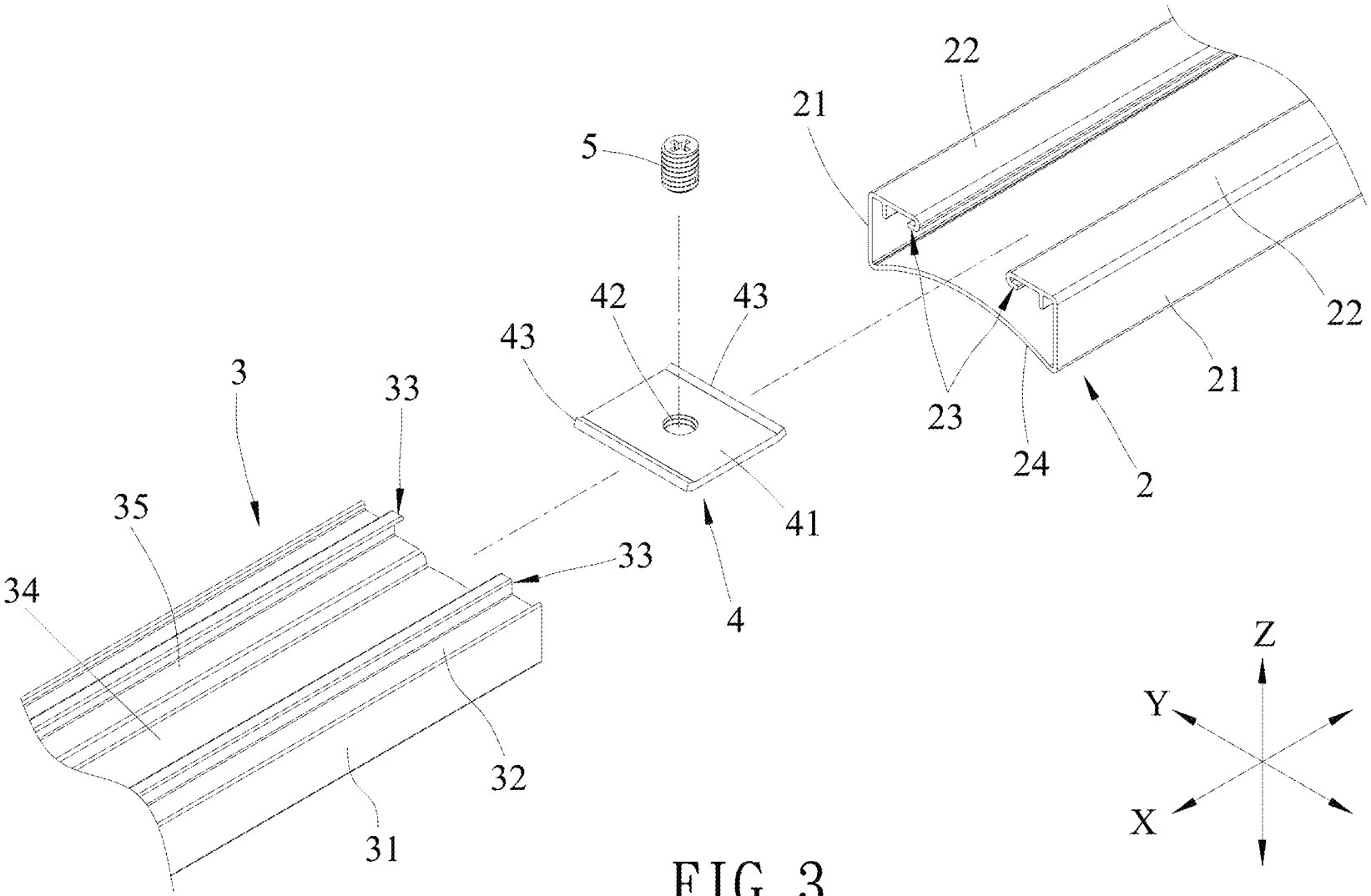
FIG. 3 is a fragmentary, exploded perspective view of a portion of FIG. 2.

Referring to FIGS. 1 to 3, an embodiment of a mounting device 1 according to the disclosure is adapted for mounting a blind 10, and includes a connecting rail 2, two slide rails 3, two abutting plates 4, two screw bolts 5 and two mounting brackets 6.

The connecting rail 2 extends along a lengthwise direction (X). The two slide rails 3 are respectively and slidably connected with two ends of the connecting rail 2. Each slide rail 3 is slidable relative to the connecting rail 2 along the lengthwise direction (X).

Figure 4:
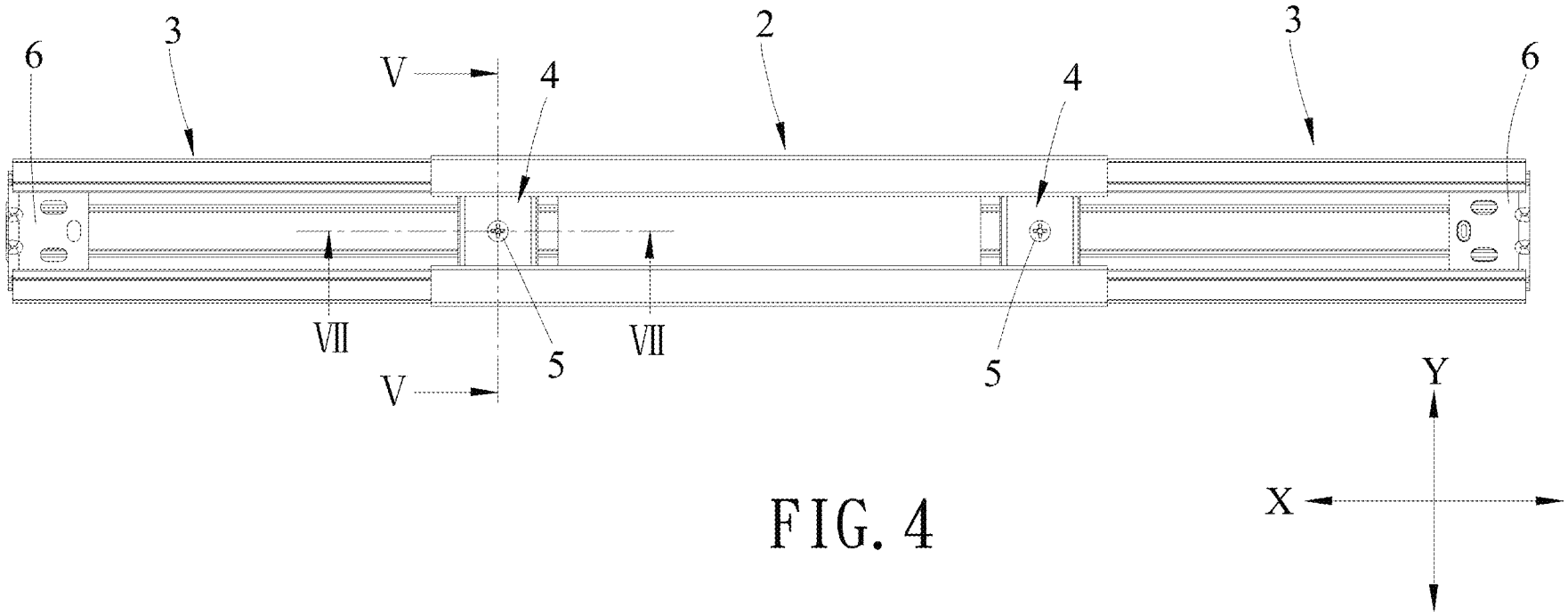
FIG. 4 is a top view of the embodiment.
Figure 5:
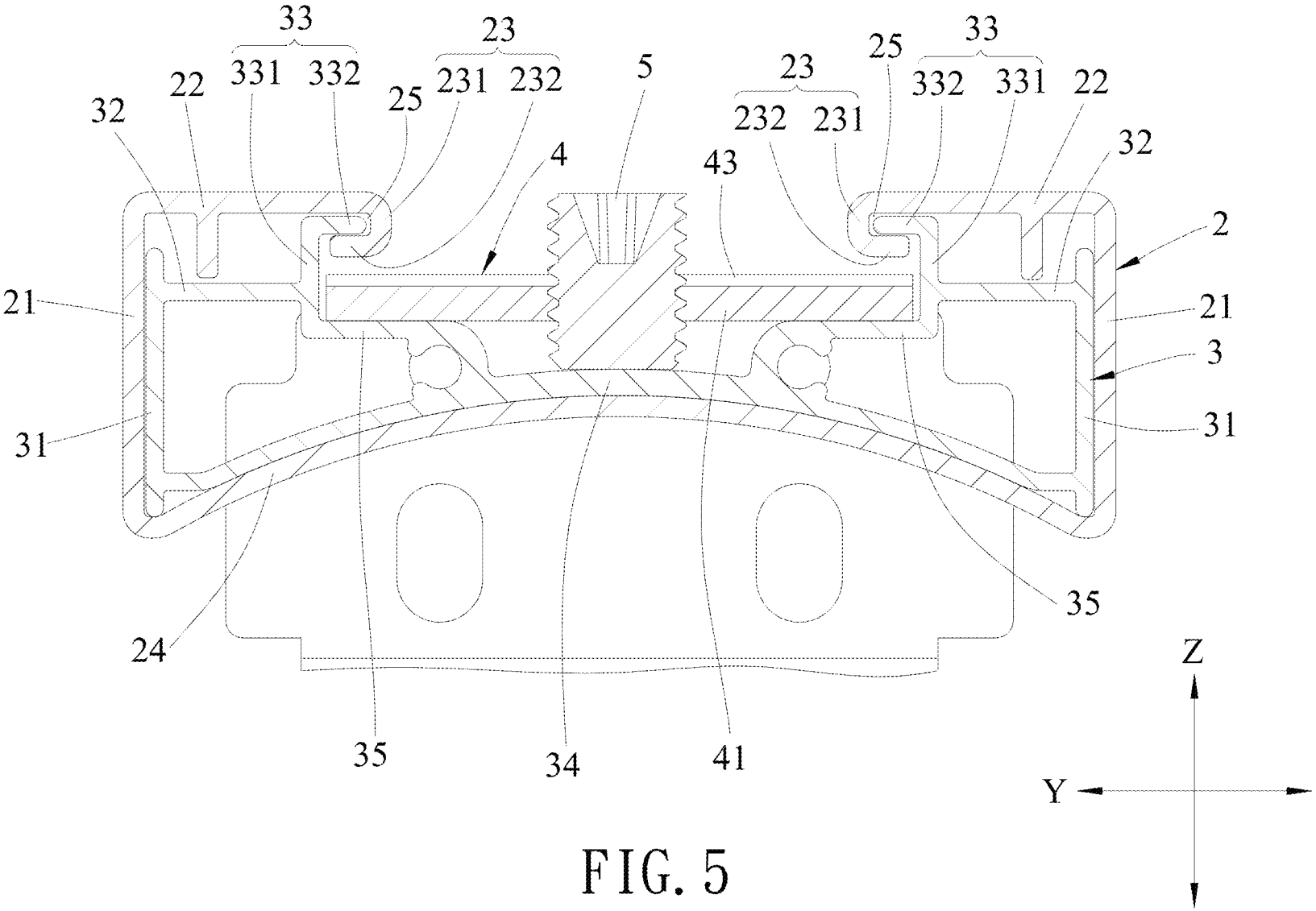
FIG. 5 is a sectional view taken along line V-V of FIG. 4, illustrating an abutting plate of the embodiment in a loosening position.

Specifically, with reference to FIGS. 2, 4 and 5, the connecting rail 2 has two outer upright walls 21 spaced apart from each other in a width direction (Y) that is transverse to the lengthwise direction (X), two outer top walls 22 respectively connected with top ends of the two outer upright walls 21 and extending toward each other in the width direction (Y), two outer anchoring walls 23 respectively connected with ends of the outer top walls 22 distal from the outer upright walls 21, and an outer interconnecting wall 24 interconnecting bottom ends of the two outer upright walls 21.

Each outer anchoring wall 23 has an L-shaped cross-section, and includes an outer extending wall section 231 which extends downwardly in an up-down direction (Z) that is transverse to both the lengthwise direction (X) and the width direction (Y) from the corresponding outer top wall 22, and an outer abutting wall section 232 which is connected with and extends from the outer extending wall section 231 outwardly in the width direction (Y). The outer top wall 22 and the outer anchoring wall 23 cooperatively define a slide slot 25 which extends along the lengthwise direction (X).

With reference to FIGS. 2, 3 and 5, each slide rail 3 is slidable along the lengthwise direction (X) relative to the connecting rail 2 so as to project from or retreat into the connecting rail 2. Each slide rail 3 has two inner upright walls 31 which are respectively disposed adjacent to and inwardly of the outer upright walls 21, two inner top walls 32 which are respectively connected with upper ends of the inner upright walls 31, disposed respectively below the outer top walls 22 and extend toward each other in the width direction (Y), two inner anchoring walls 33 which extend respectively and upwardly from the inner top walls 32, an inner interconnecting wall 34 which interconnects lower ends of the two inner upright walls 31 and adjoins an upper surface of the outer interconnecting wall 24, and two inner support walls 35 each of which interconnects the inner interconnecting wall 34 and the respective inner top wall 32.

The inner anchoring walls 33 of each slide rail 3 are respectively engaged in the slide slots 25 of the connecting rail 2. Each inner anchoring wall 33 has an L-shaped cross-section to be matingly engageable with the corresponding outer anchoring wall 23, and includes an inner extending wall section 331 which extends upwardly from the corresponding inner top wall 32, and an inner abutting wall section 332 which is connected with and extends inwardly in the width direction (Y) from the inner extending wall section 331 to be engaged in the corresponding slide slot 25. The inner abutting wall section 332 of each inner anchoring wall 33 is disposed upwardly of the outer abutting wall section 232 of the corresponding outer anchoring wall 23.

With reference to FIGS. 3 and 5, each abutting plate 4 is interposed between the inner support walls 35 of the corresponding slide rail 3 and the outer abutting wall sections 232 of the connecting rail 2 in the up-down direction (Z). Each abutting plate 4 has a plate body 41, a screw hole 42 formed in the plate body 41, and two pressing portions 43 formed at two ends of the plate body 41 in the lengthwise direction (X) and bent upwardly.

The two screw bolts 5 are threadedly engaged in the screw holes 42 of the abutting plates 4. Each screw bolt 5 has a lower bolt end which extends through the screw hole 42 to be in abutting engagement with the inner interconnecting wall 34 of the corresponding slide rail 3. When the slide rails 3 are moved along the lengthwise direction (X) relative to the connecting rail 2, with the frictional contact of the screw bolts 5 with the slide rails 3, the abutting plates 4 are moved with the corresponding slide rails 3.

With reference to FIGS. 1 and 2, the two mounting brackets 6 are respectively mounted on remote ends of the slide rails 3 distal from the connecting rail 2 for mounting the blind 10 thereon in a known manner.

Figure 6:
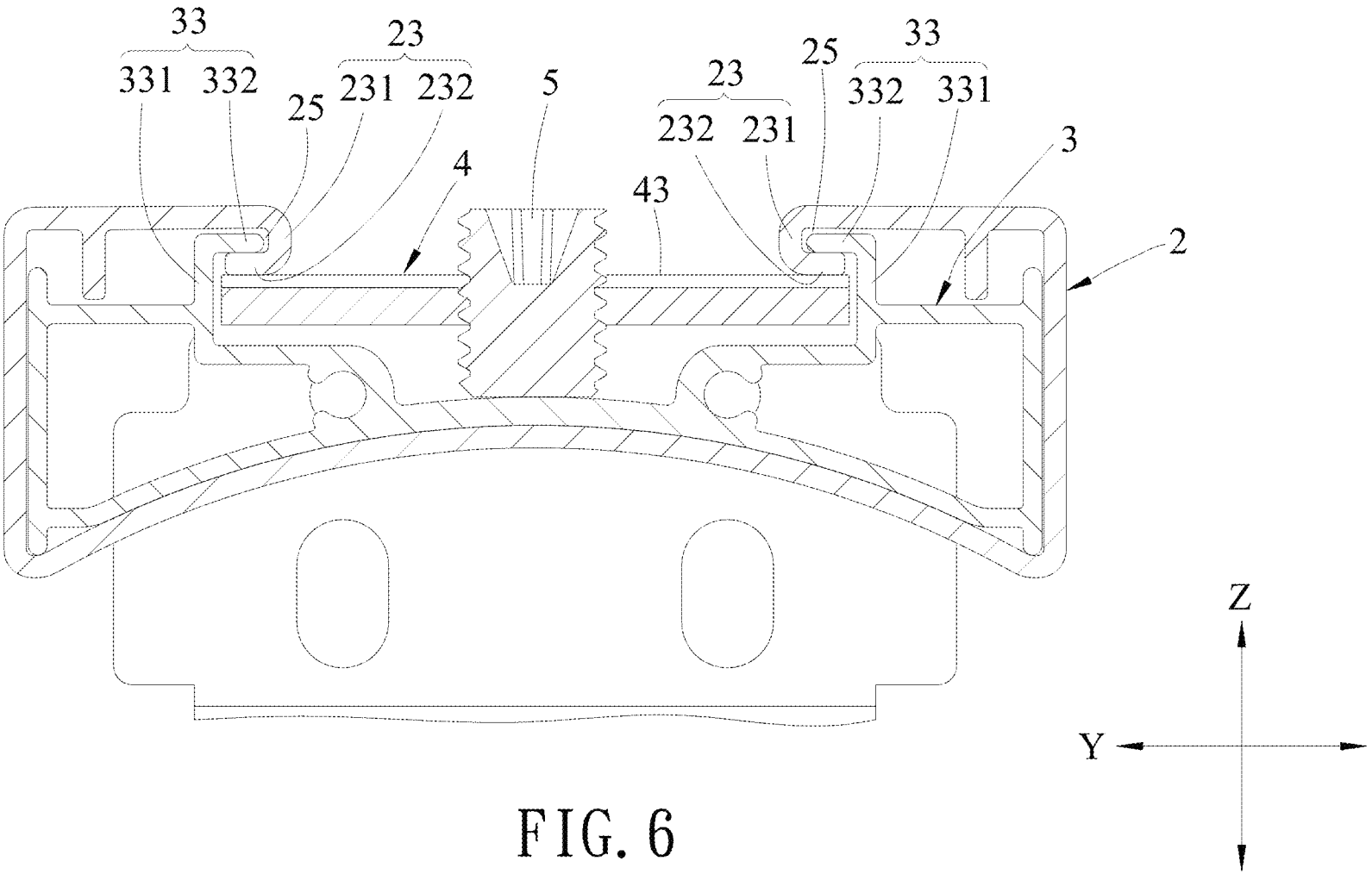
FIG. 6 is a sectional view similar to FIG. 5, illustrating the abutting plate in a tightening position.

With reference to FIGS. 5 and 6, when the screw bolts 5 are rotated while in abutting engagement with the inner interconnecting walls 34 of the slide rails 3, the abutting plates 4 are driven and moved in the up-down direction (Z) between a loosening position and a tightening position.

Figure 7:
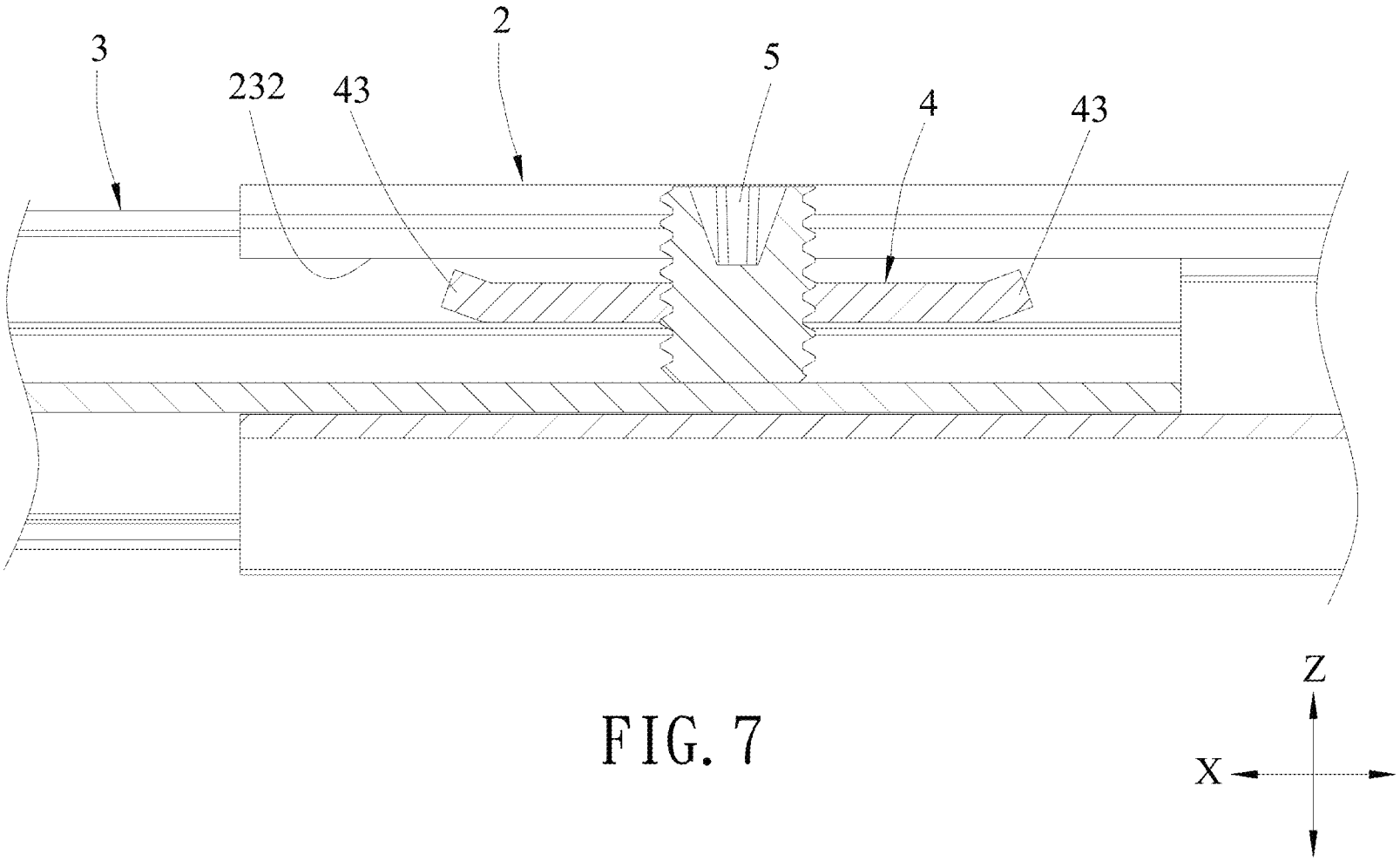
FIG. 7 is a sectional view taken along line VII-VII of FIG. 4, illustrating the abutting plate in the loosening position.

With reference to FIGS. 1, 5 and 7, when the abutting plates 4 (only one abutting plate 4 is shown in FIGS. 5 and 7) are in the loosening position, upper surfaces of the abutting plates 4 are moved away from the outer abutting wall sections 232 of the connecting rail 2. That is to say, upper surfaces of the pressing portions 43 of each abutting plate 4 are spaced apart from the outer abutting wall sections 232. At this stage, the outer abutting wall sections 232 are spaced apart from the inner abutting wall sections 332 of each slide rail 3 in the up-down direction (Z), and the inner abutting wall sections 332 of each slide rail 3 are spaced apart from the outer top walls 22 of the connecting rail 2 in the up-down direction (Z). Hence, the slide rails 3 are loosely engaged with the connecting rail 2 so as to permit sliding movement of the slide rails 3 relative to the connecting rail 2 along the lengthwise direction (X) so as to adjust the length of the mounting device 1.

Figure 8:
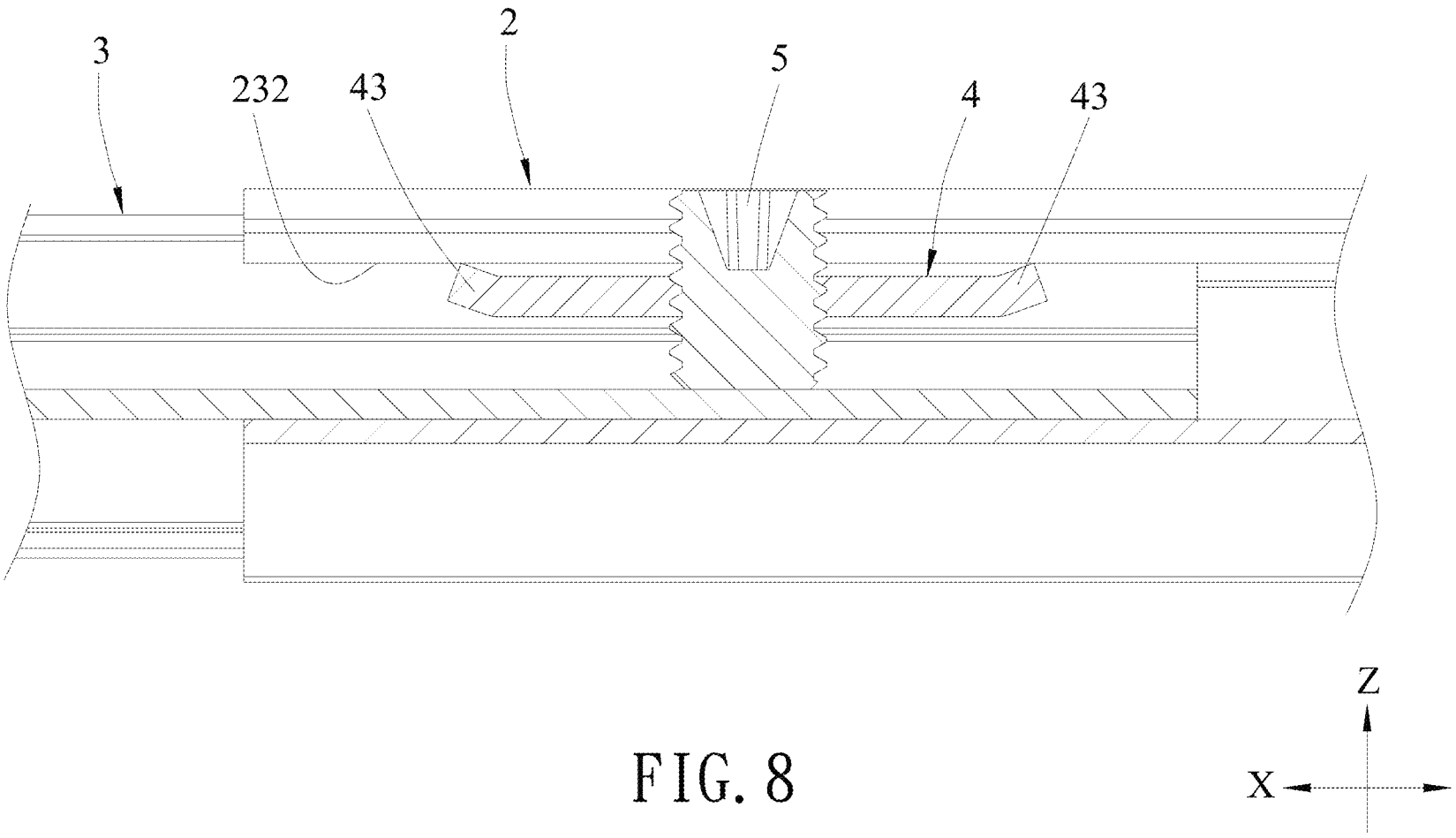
FIG. 8 is a sectional view similar to FIG. 7, illustrating the abutting plate in the tightening position.

With reference to FIGS. 6 and 8, when the abutting plates 4 (only one abutting plate 4 is shown in FIGS. 6 and 8) are in the tightening position, the abutting plates 4 are moved toward the outer anchoring walls 23 of the connecting rail 2 and the upper surfaces of the pressing portions 43 of each abutting plate 4 is in upwardly abutting engagement with lower surfaces of the outer abutting wall sections 232 of the connecting rail 2 such that the outer abutting wall sections 232 are in tight engagement with the inner abutting wall sections 332 of each slide rail 3 by a frictional force and that the slide rails 3 are in tight engagement with the connecting rail 2 so as to prevent sliding movement of the slide rails 3 relative to the connecting rail 2.

Specifically, when the abutting plates 4 are in the tightening position, the outer abutting wall sections 232 of the connecting rail 2 are most tightly engaged with the inner abutting wall sections 332 of each slide rail 3 at areas where the pressing portions 43 of each abutting plate 4 abut and press against the outer abutting wall sections 232.

Figure 9:
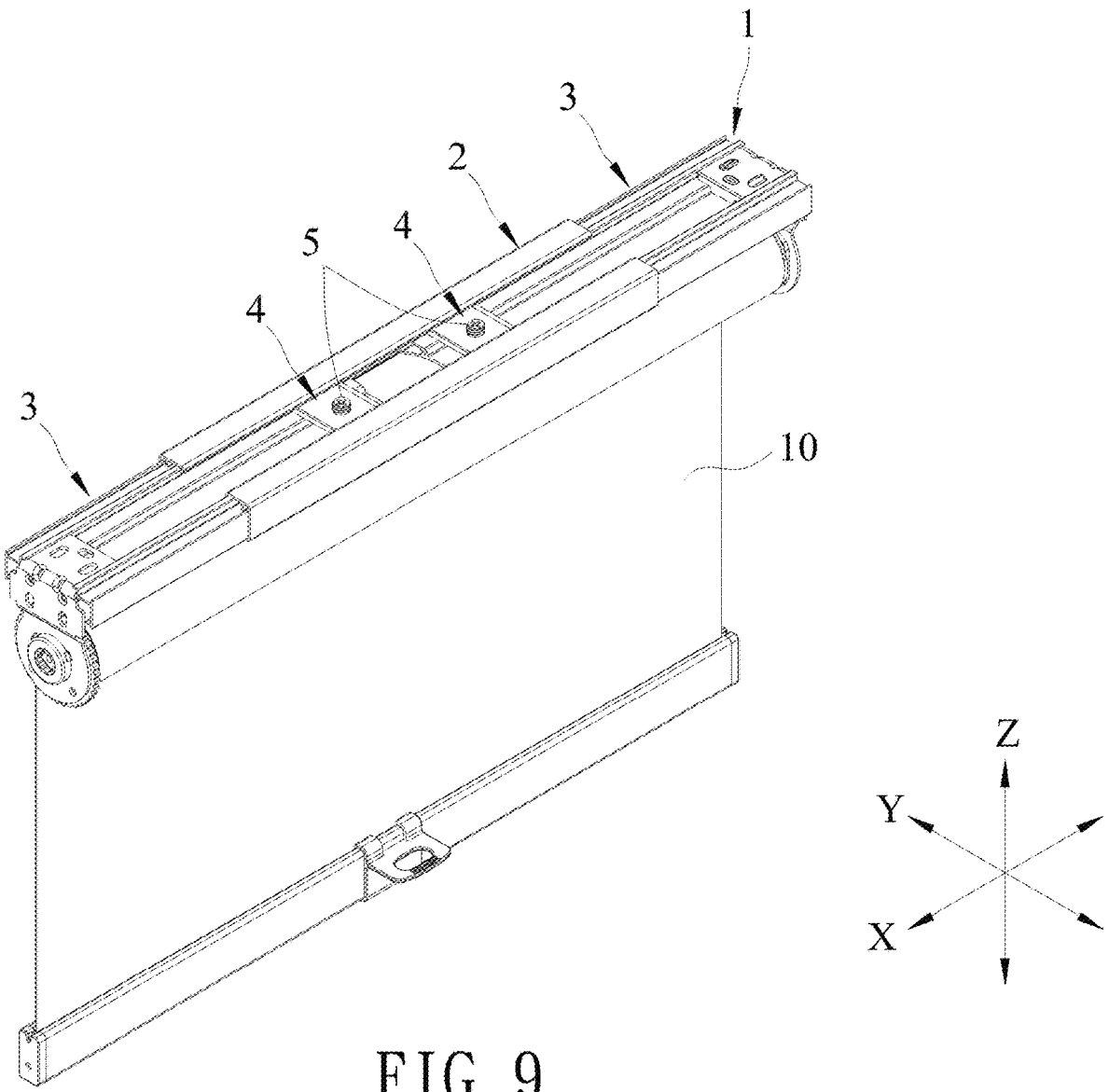
FIG. 9 is a perspective view illustrating the embodiment in an adjusted state.

With reference to FIGS. 1 and 9, when it is desired to adjust the length of the mounting device 1 for mounting a blind 10 cut by a customer, through rotation of the screw bolts 5, the abutting plates 4 are moved to the loosening position, and the slide rails 3 are movable along the lengthwise direction (X) relative to the connecting rail 2 to retreat into the connecting rail 2. The length of the mounting device 1 may be adjusted to correspond with the blind 10 that is to be mounted. Subsequently, through the rotation of the screw bolts 5, the abutting plates 4 are moved to the tightening position so as to prevent movement of the slide rails 3 relative to the connecting rail 2.

As illustrated, with the slide rails 3 and the connecting rail 2, the length of the mounting device 1 is adjustable for mounting blinds 10 with a variety of dimensions. Through the operation of the screw bolts 5 by the customer, the abutting plates 4 may be moved to the loosening position to permit adjustment of the length of the mounting device 1, and to the tightening position to prevent the sliding movement of the slide rails 3 relative to the connecting rail 2 so as to firmly retain the length of the mounting device 1, which improves convenience and stability of use.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A mounting device for a blind, comprising:

a connecting rail extending along a lengthwise direction;

two slide rails respectively and slidably connected with two ends of said connecting rail, each of said slide rails being slidable relative to said connecting rail along the lengthwise direction;

two abutting plates, each interposed between a respective one of said slide rails and said connecting rail in an up-down direction that is transverse to the lengthwise direction, each of said abutting plates being moved with the respective one of said slide rails relative to said connecting rail along the lengthwise direction, and having a plate body and a screw hole formed in said plate body;

two screw bolts, each threadedly engaged in said screw hole of a respective one of said abutting plates and having a lower bolt end which extends through said screw hole to be in abutting engagement with the respective one of said slide rails; and two mounting brackets respectively mounted on said slide rails for mounting the blind thereon;

wherein, through rotation of said screw bolts, said abutting plates are movable in the up-down direction between a tightening position, where an upper surface of each of said abutting plates is in upwardly abutting engagement with said connecting rail so that said connecting rail is in tight contact with said slide rails by a frictional force so as to prevent sliding movement of said slide rails relative to said connecting rail, and a loosening position, where said upper surface of each of said abutting plates is moved away from said connecting rail so as to permit the sliding movement of said slide rails relative to said connecting rail along the lengthwise direction.

2. The mounting device of claim 1, wherein said connecting rail has two outer anchoring walls which are disposed upwardly of said abutting plates and spaced apart from each other in a width direction that is transverse to both the lengthwise direction and the up-down direction, each of said slide rails having two inner anchoring walls which respectively anchor said outer anchoring walls, each of said outer anchoring walls including an outer abutting wall section disposed adjacent to said abutting plates, each of said inner anchoring walls including an inner abutting wall section which is disposed upwardly of said outer abutting wall section, wherein said outer abutting wall sections of said connecting rail are respectively spaced apart from said inner abutting wall sections of each of said slide rails in the up-down direction when each of said abutting plates is in the loosening position, and each of said abutting plates is in upwardly abutting engagement with said outer abutting wall sections when each of said slide rails is in the tightening position, such that said outer abutting wall sections are in upwardly abutting engagement with said inner abutting wall sections so that said outer abutting wall sections are in tight contact with said inner abutting wall sections by the frictional force.

3. The mounting device of claim 2, wherein each of said abutting plates has two pressing portions which are formed at two ends of said plate body in the lengthwise direction and bent upwardly, said pressing portions having said upper surfaces which are respectively in upwardly abutting engagement with lower surfaces of said outer abutting wall sections of said connecting rail when each of said abutting plates is in the tightening position, such that said outer abutting wall sections are in tight contact with said inner abutting wall sections of a corresponding one of said slide rails.

4. The mounting device of claim 2, wherein said connecting rail has two outer upright walls spaced apart from each other in the width direction, two outer top walls respectively connected with top ends of said two outer upright walls and extending toward each other in the width direction, and an outer interconnecting wall interconnecting bottom ends of said two outer upright walls, said outer anchoring walls being respectively connected with ends of said outer top walls distal from said outer upright walls, each of said outer anchoring walls further including an outer extending wall section which extends downwardly from a corresponding one of said outer top walls and is connected with a corresponding one of said outer abutting wall sections;

each of said slide rails having two inner upright walls which are respectively disposed adjacent to and inwardly of said outer upright walls, two inner top walls which are respectively connected with upper ends of said inner upright walls, disposed respectively below said outer top walls and extend toward each other in the width direction, an inner interconnecting wall which interconnects lower ends of said two inner upright walls and adjoins an upper surface of said outer interconnecting wall, and two inner support walls each of which interconnects said inner interconnecting wall and a respective one of said inner top walls, said inner interconnecting walls of said slide rails being respectively in abutting engagement with said screw bolts, each of said inner anchoring walls further including an inner extending wall section which extends upwardly from a corresponding one of said inner top walls and is connected with a corresponding one of said inner abutting wall sections.

* * * * *